United States Patent [19]

Linhardt et al.

[11] Patent Number: 4,758,842

[45] Date of Patent: Jul. 19, 1988

[54] HORN ANTENNA ARRAY PHASE MATCHED OVER LARGE BANDWIDTHS

[75] Inventors: Wilbur J. Linhardt; Robert J. Patin, both of Hawthorne, Calif.

[73] Assignee: Hughes Aircraft Company, Los Angeles, Calif.

[21] Appl. No.: 864,370

[22] Filed: May 19, 1986

[51] Int. Cl.[4] ..... H01Q 13/02

[52] U.S. Cl. ..... 343/786; 343/772; 343/778

[58] Field of Search ..... 343/772, 776, 786, 778

[56] References Cited

U.S. PATENT DOCUMENTS

| | | | |
|---|---|---|---|
| 2,669,658 | 2/1954 | Jackson | 343/781 R |
| 2,720,588 | 10/1955 | Jones | 343/754 |
| 3,045,238 | 7/1962 | Cheston | 343/776 |
| 3,553,692 | 1/1971 | Drabowitch | 343/786 |
| 3,555,553 | 1/1971 | Boyns | 343/776 |

FOREIGN PATENT DOCUMENTS

| | | | |
|---|---|---|---|
| 0102686 | 3/1984 | European Pat. Off. . | |
| 3331023 | 3/1985 | Fed. Rep. of Germany | 343/786 |
| 629151 | 9/1949 | United Kingdom . | |
| 1311971 | 3/1973 | United Kingdom . | |
| 2090068 | 6/1982 | United Kingdom | 343/786 |

OTHER PUBLICATIONS

The Sectoral Electromagnetic Horn, Barrow, W. L., Lewis, F. D., Proceeding of the Institute of Radio Engineers, vol. 27, No. 1, Jan. 1939.

Cohn, Seymour B., Flare Angle Changes in a Horn as a Mean of Pattern Control, Microwave Journal, 10/70, pp. 41–46.

*Primary Examiner*—William L. Sikes

*Assistant Examiner*—Doris J. Johnson

*Attorney, Agent, or Firm*—S. M. Mitchell; M. J. Meltzer; A. W. Karambelas

[57] ABSTRACT

An array of horn antennas with non-uniform aperture sizes is disclosed wherein the individual horns phase track over a wide frequency band. The horn with the smallest aperture is considered the reference horn, and its length defines the overall horn length of the other horn in the array. The flare lengths of the other horns of the array are less than the length of the reference horn, and lengths of waveguide are added to the other horns such that the respective combined flare lengths and waveguide lengths of each of the other horns equals the horn length of the reference horn. The respective lengths of the flare and the waveguide section are chosen such that the resultant horn antenna phase tracks the reference horn over the frequency band. Therefore, horn antennas of various aperture sizes, and restricted to a maximum length can be phase matched over a band of frequencies by reducing the flared length of each horn in relation to that of the smallest or reference horn, and making up the resulting length difference by a waveguide section.

5 Claims, 4 Drawing Sheets

HORN ANTENNA ARRAY PHASE MATCHED OVER LARGE BANDWIDTHS

BACKGROUND OF THE INVENTION

The present invention relates to arrays of horn antennas, and more particularly to a method for designing the horns for non-frequency-dispersive operation over a wide bandwidth.

The bandwidth over which conventional horn antenna feed networks have been operated has been limited to a relatively narrow bandwidth, such that the phase dispersion between horn antennas with differently sized apertures has been kept within an allowable range. A recent innovation, described in the pending patent application entitled "Combined Uplink and Downlink Satellite Antenna Feed Network," filed May 19, 1986, as Ser. No. 864,684 and assigned to a common assignee, is the combination of the previously separate uplink and downlink feed networks in a satellite into one combined network. With such a combined network, the bandwidth over which the horn array must operate is much larger, with the consequence that the phase dispersion between horns of differently sized apertures becomes intolerable. One consequence of the phase dispersion is that the array coverage pattern shifts with frequency.

It would therefore be advantageous to provide a method of designing an array of horn antennas with different aperture sizes in which the horns will phase track over a wide frequency band.

SUMMARY OF THE INVENTION

An array of horn antennas having non-uniform aperture sizes and which phase track over a wide frequency band is disclosed. The array comprises a first or reference horn antenna having the smallest aperture of the horns comprising the array. The reference horn has an overall reference length and a predetermined phase delay for RF signals at a particular frequency within the frequency band. Each of the other horns in the array has a larger aperture size than the reference horn, and comprises a waveguide section and a flare section terminating in the horn aperture. The overall aggregate length of the waveguide section and the flared section of each horn is substantially equal to the overall length of the reference horn. The waveguide section and the flared section of each horn have predetermined phase slopes, and their respective lengths are selected such that the aggregate phase delay of the respective horn is substantially equal to the reference horn phase delay. The phase delays through the horns substantially track over a wide frequency bandwidth, thereby preventing degradation of the array pattern as the frequency shifts.

BRIEF DESCRIPTION OF THE DRAWINGS

These and other features and advantages of the present invention will become more apparent from the following detailed description of an exemplary embodiment thereof, as illustrated in the accompanying drawings, in which.

DETAILED DESCRIPTION OF THE DISCLOSURE

Figure 1:
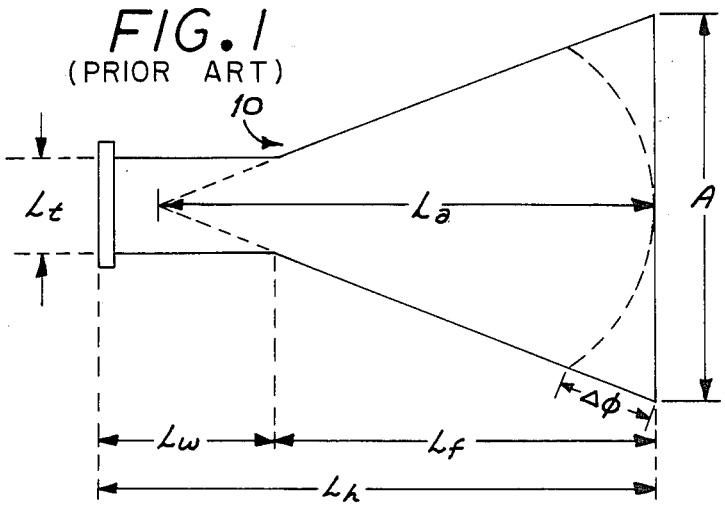
FIG. 1 (PRIOR ART)
FIG. 1 is a top view of a typical horn antenna.

Horn antennas are well-known antenna array components. A typical horn antenna 10 is shown in the top view of FIG. 1 and has an overall length $L_h$ equal to the sum of the flare length $L_f$ and the waveguide length $L_w$. The horn aperture A measures the horn H-plane dimension. The throat of the horn has a dimension $L_t$. The axial length $L_a$ of the horn is measured between the aperture and the intersection of the projected flared walls of the horn.

The invention relates to an array of horn antennas having different aperture sizes in which the individual horns will phase track over a wide frequency band. The invention exploits the different phase slope characteristics of horn antennas and waveguide.

For the rectangular aperture horn, the phase delay through the horn (its electrical length) is primarily determined by the H-plane dimension A, the horn length and the size of the horn throat opening. The phase slope characteristic is a measure of the phase delay of the horn per unit length of the horn. The phase slope is a constant for given aperture and throat dimensions irrespective of the horn length, and this characteristic is exploited by the invention.

Figure 2:
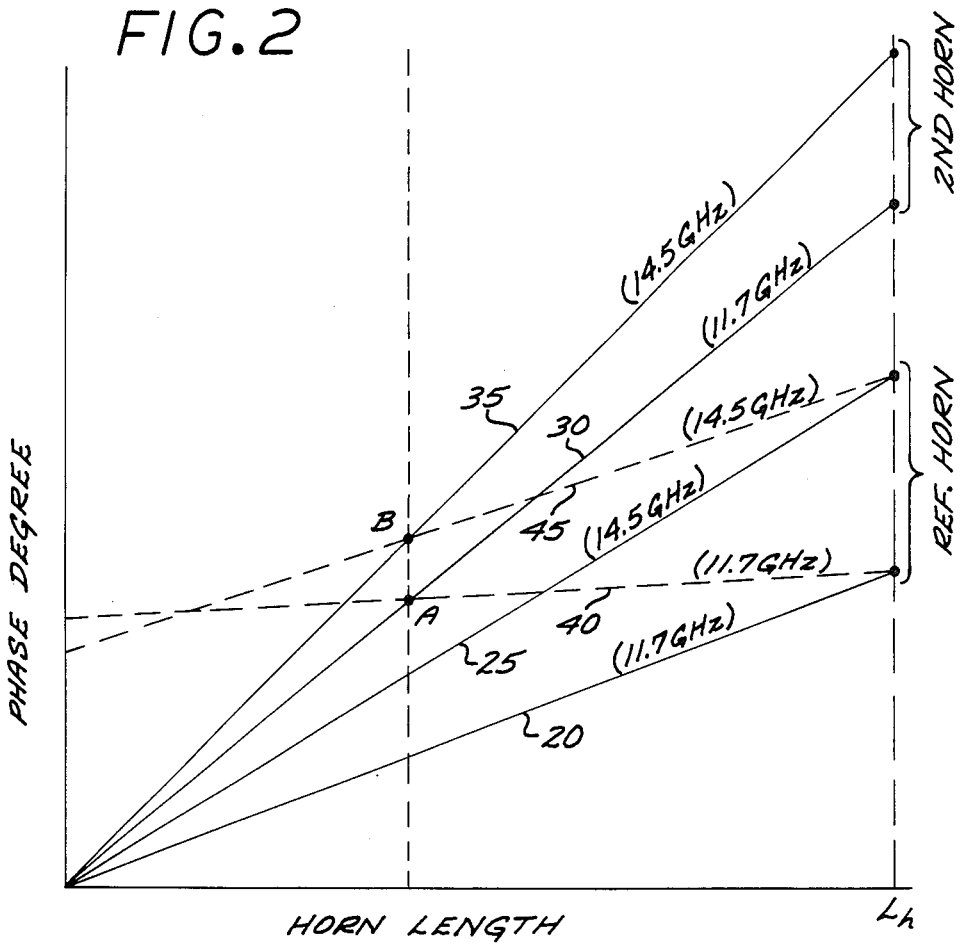
FIG. 2 is a plot of the horn phase delay for two horns of different aperture sizes as a function of horn length at selected high and low frequencies.

FIG. 2 illustrates the phase slope of two different horn antennas at two frequency boundaries (11.7 and 14.5 Ghz) of the frequency band of interest, one horn having a larger aperture, but each with the same overall length, bandwidth and center frequency. For purposes of description of the invention, the horn with the smaller aperture will be considered the reference horn. Line 20 illustrates the phase slope of the reference horn at the lower frequency, 11.7 Ghz. Line 25 illustrates the phase slope of the same horn at the upper frequency, 14.5 Ghz.

Lines 30 and 35 represent the phase slope of the second horn at the respective upper and lower frequencies, 11.7 Ghz and 14.5 Ghz. Because the aperture of the second horn is larger than the aperture of the reference horn, it has a longer electrical length than the first horn, and the phase delay through the second horn is larger than the phase delay through the reference horn.

For purpose of this example, it is assumed that the first horn depicted in FIG. 2 has a waveguide section length $L_w$ equal to zero.

The phase slopes of standard waveguide sections whose cross-sectional configurations match those of the throats of the reference and second horn antennas are also depicted in FIG. 2 by lines 40 and 45, for the respective lower and upper frequencies of interest. For illustration of the invention, the respective phase delays of the waveguide sections for lengths equal in length to the reference horn are shown to equal, or are referenced to, the phase delay of the reference horn at the upper and lower frequencies of interest.

It is noted that line 40, representing the waveguide phase slope referenced to the phase shift of the reference horn at the lower frequency, intersects line 30, the lower frequency phase slope of the second horn, at point A illustrated in FIG. 2. Line 45, representing the waveguide phase slope referenced to the phase shift of the reference horn at the upper frequency, intersects line 35, the high frequency phase slope of the second horn, at point B. It is significant that the two points A and B occur at substantially the same value of length "X" along the horizontal axis. As will be described, the value of X represents the optimized flare length $L_f$ of the second horn and the corresponding waveguide length $L_w = L_h - L_f$ necessary to optimize the second horn to phase track the reference horn. Thus, FIG. 2 represents the analytic solution for the determination of the lengths $L_f$ and $L_w$, given the parameters of the required total phase slope of the optimized horn and the phase slopes of the nonoptimized horn flared section and the waveguide section. The solution represents the intersection of the two lines 35 and 45, and the two lines 30 and 40.

With the second horn having the flare length and waveguide length selected as described above, the phase slope of the waveguide section changes as the frequency changes so as to keep the value of X substantially equal to the same constant. As the frequency increases, the ideal flare length of a given flare section decreases, while the ideal length of the waveguide section increases, thereby compensating for the change in electrical length of the two sections. With the lengths of the waveguide and flared sections chosen appropriately, this mutual compensation results in the horn having a substantially constant electrical length over a wide frequency band. Therefore, horns of various aperture sizes and restricted to a maximum overall length can be phase matched over a band of frequencies by reducing the flare length of each horn relative to the flare length of the horn with the smallest aperture, with the difference in the overall horn length being made up in waveguide sections.

The invention may be further illustrated with reference to the specific example illustrated in FIG. 3. In this example, the reference horn antenna has a phase delay of 700° at the center frequency of the band between 11.7 Ghz and 14.5 Ghz, an overall length of 12 inches and a two inch aperture dimension. The second non-optimized horn antenna would have flare length and a phase delay of 800° at the same frequency, the same overall physical length as the reference horn, and a four inch aperture. The goal is to optimize the second horn so that its electrical length equals that of the reference horn over a wide frequency range, while maintaining the physical aperture and length dimensions of the second horn.

The phase slope of the reference horn is depicted by line 50 between the points having coordinates $(X_1, Y_1)$ and $(X_3, Y_3)$. The phase slope of the larger horn is depicted by line 55 between the points having coordinates $(X_1, Y_1)$ and $(X_2, Y_2)$. This slope m1 is equal to $Y_2/X_2$, for the case where $X_1$ and $Y_1$ are zero. The phase slope m2 of a standard waveguide section is shown as dotted line 60 extending between the points having coordinates $(X_4, Y_4)$, and $(X_3, Y_3)$. The slope m2 may be written as equal to $(Y_4-Y_3)/(X_4-X_3)$. This phase slope m2 is also equal to $360°/\lambda_g$, where $\lambda_g$ represents the waveguide wavelength.

Figure 3:
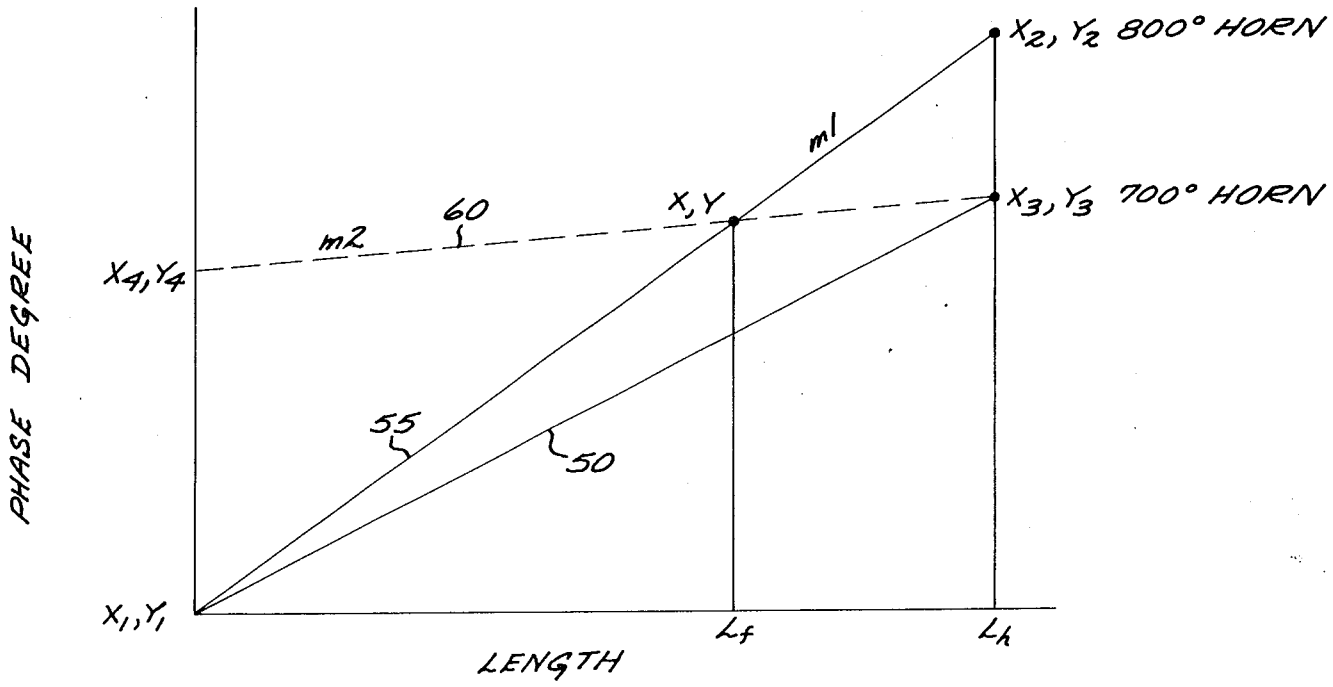
FIG. 3 is a plot of the phase delay as a function of horn length for two horns of different aperture sizes.

Solution of the two equations defining the lines 55 and 60 having the respective slopes m1 and m2 shown in FIG. 3 results in the solution for the value $x = L_f$, defining the flare length of the optimized horn with the four inch aperture. The equation relating the value of y to x for the line 55 having slope m1 is given by Equation 1.

$$y = (m1)x \tag{1}$$

The equation relating the value of y and x for line 60 having the slope m2 is given by Equation 2.

$$y = Y_4 + x(m2) \tag{2}$$

Since $Y_4 = Y_3 - (m2)X_3$, Equations 1 and 2 may be solved for their intersection point $x = L_f$:

$$L_f = \frac{Y_3 - (m2)X_3}{m1 - m2} \tag{3}$$

The length of the waveguide section needed to complete the phase compensation is simply the horn length $L_h$ minus the flare length $L_f$, with the overall horn length being equal to the overall length of the reference horn.

The above calculations may be readily implemented by a digital computer to automate the design process. An exemplary program for the Basic programming language is given in Table I.

TABLE I

```
10 DIM J(30)
20 DIM X(30)
30 INPUT "NO OF LARGE HORNS",N
40 INPUT "APERTURE H PLANE SMALL HORN",A1
50 PRINT "APERTURE H PLANE SMALL HORN",A1
60 INPUT "THROAT DIMENSION",A2
70 PRINT "THROAT DIMENSION",A2
80 INPUT "HORN LENGTH",D
90 PRINT "HORN LENGTH",D
100 INPUT "FREQUENCY GHZ",F
110 PRINT "FREQUENCY GHZ",F
120 RAD
130 Y=11.80285/F
140 B=(SQR(((A1/2)^2)-((Y/4)^2)))-((Y/4)*
    (ACS(ABS(Y/(2*A1)))))
150 C=(SQR(((A1/2)^2)-((Y/4)^2)))-((Y/4)*
    (ACS(ABS(Y/(2*A2)))))
160 E=B-C
170 A5=(A1-A2)/2
180 W=A5/D
190 T=(E*2*PI)/(W*Y)
200 S=(180*1)/PI)
201 S=DROUND(S,6)
210 PRINT "PHASE DEGREES SMALL HORN",S
220 PRINT "HORN NO", "APERTURE", "HORN
    FLARE", "HORN PHASE", "CORRECTED PHASE."
230 FOR I=1 TO N
240 INPUT "APERTURE LARGE HORN",K(I)
250 H(I)=(SQR(((K(I)/2)^2)-((Y/4)^2)))-((Y/4)*
    (ACS(ABS(Y/2*K(I))))))
260 G(I)=(SQR(((A2/2)^2-((Y/4)^2)))-((Y/4)*
    (ACS(ABS(Y/(2*A2)))))
270 L(I)=H(I)-G(I)
280 0(I)=(K(I)-A2)/2
290 P(I)=O(I)/D
300 Q(I)=(L(I)*2*PI)/(P(I)*Y)
310 J(I)=180*Q(I)/PI
320 U = Y/(SQR(1-((Y/(2*A2))^2)))
330 M2=360/U
340 M(I)=J(I)/D
350 X(I)=(M2*D-S)/(M2-M(I))
360 H1(I)=(SQR(((K(I)/2)^2)-((Y/4)^2))) -
    ((Y/4)*(ACS(ABS(Y/(2*K(I)))))))
370 G1(I)=(SQR(((A2/2)^2)-((y/4)^2))) -
    ((Y/4)*(ACS(ABS(Y/(2*A2)))))
380 L1(I)=H1(I)-G1(I)
390 O1(I)=(K(I)-A2)/2
400 P1(I)=O1(I)/X(I)
```

TABLE I-continued

```
410 Q1(I)=(L1(I)*2PI)/(P1(I)*Y)
420 J1(I)=180*Q1(I)/PI
430 D1(I)=D-X(I)
440 B1(I)=(360/U)*D1(I)
450 C1(I)=B2(I)+J1(I)
451 X(I)=DROUND(X(I),5)
452 J(I)=DROUND(J(I),6)
453 C1(I)=DROUND(C1(I),6)
460 PRINT I,K(I),X(I), IAB(42), J(I), TAB(64), C1(I)
470 NEXT I
480 END
```

Figure 4A:
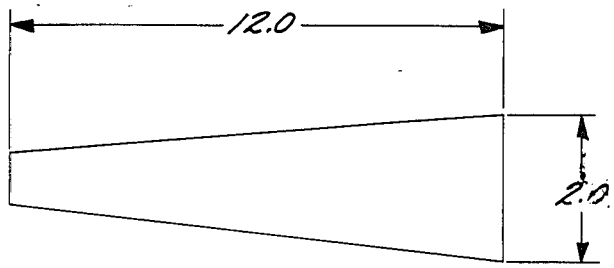
FIG. 4A depicts a simplified representation of a reference horn antenna having an overall length of 12 inches and a 2 inch aperture.
Figure 4B:
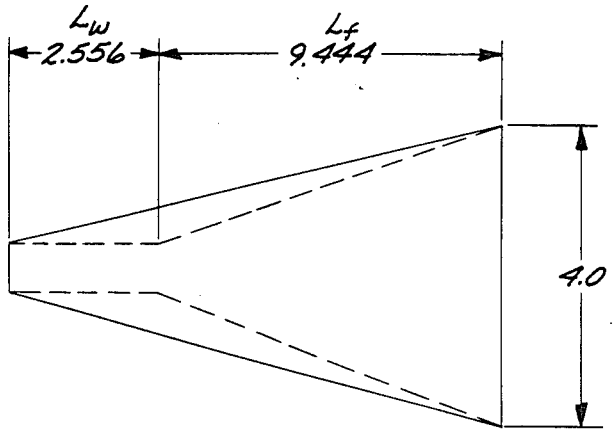
FIGS. 4B and 4C depict simplified representations of a horn antenna having a 12 inch length and a 4 inch aperture, respectively optimized (dashed lined) at two different frequencies within a frequency band of interest.
Figure 4C:
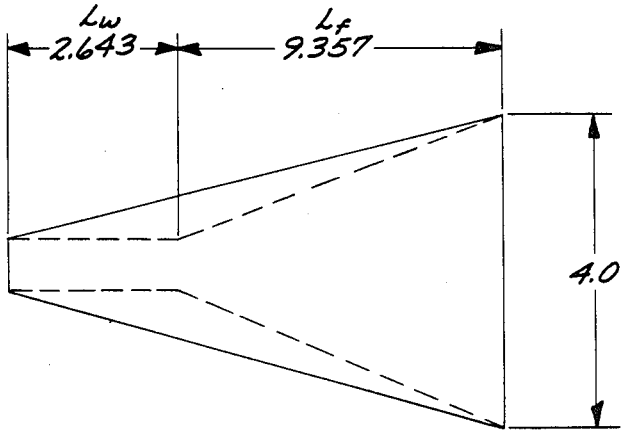

The example of FIG. 3 is further depicted in FIGS. 4A, 4B and 4C, which respectively show simplified top views of the reference horn (with no wavelength section), the larger aperture horn optimized by the present method at the lower frequency of interest (11.7 Ghz) and the larger aperture horn optimized by the present method at the upper frequency of interest (14.5 Ghz).

The reference horn with a two inch aperture has a total calculated electrical length equivalent to phase shifts of 3894.67° and 5002.09° at the respective upper and lower frequencies. The phase shift of the horn (non-optimized) having the four inch aperture is calculated as 4090.95° at 11.7 Ghz and 5155.83° at 14.5 Ghz. Thus, the phase dispersion between the two horns (without optimization) is 198.25° at the lower frequency, and 156.28° at the upper frequency.

Using the computer program shown in Table I, the horn design is optimized at 11.7 Ghz and at 14.5 Ghz. At the lower frequency (11.7 Ghz), the flare length and waveguide length are calculated as 9.444 inches and 2.556 inches, respectively. This is illustrated in FIG. 4B, where the non-optimized horn is depicted in solid lines, and the optimized horn is depicted in dashed lines. At 11.7 Ghz, the flared section of the optimized horn has a calculated phase delay of 3219.58°, and the waveguide section has a total phase delay of 675.11°. Thus, the total phase delay of the optimized horn at 11.7 Ghz is 3894.69°, exactly equivalent to the calculated reference horn phase delay. At 14.5 Ghz, the flared section of the optimized horn has a calculated phase delay of 4057.64°, and the waveguide section has a phase delay of 949.50°. The total phase delay of the optimized horn at 14.5 Ghz is 5007.14°, which differs from the calculated reference horn phase delay at the same frequency by 5.05°.

Also using the computer program of Table I, the horn design is optimized at 14.5 Ghz. This results in slightly different calculated dimensions for $L_f$ and $L_w$, 9.357 inches and 2.643 inches, respectively. This design is illustrated in FIG. 4C, where the non-optimized horn is depicted by the solid lines, and the optimized horn is depicted by the dashed lines. At 14.5 Ghz, the flared section of the optimized horn has a calculated phase delay of 4020.26°, and the waveguide section has a phase delay of 981.82°. Thus, the total phase delay through the optimized horn at 14.5 Ghz is 5002.09°, exactly equivalent to the calculated reference horn phase delay at this frequency. At 11.7 Ghz, the flared section of the optimized horn has a calculated phase delay of 3189.92° and the waveguide section has a phase delay of 698.02°.

Thus, the total phase delay through the optimized horn of FIG. 4C at 11.7 Ghz is 3887.94°. This differs from the calculated reference horn phase for this frequency delay by 6.75°.

The mutual phase compensation provided by the horn optimization is further illustrated from the respective phase delays of the flare and waveguide sections at the upper and lower frequencies for the two horn optimizations. The 2.643 inch waveguide section has a calculated phase delay of 981.82° at 14.5 Ghz, while the 2.556 inch waveguide section has a calculated phase delay of 949.50°, a difference of 32.32°. The corresponding 9.357 inch flare section has a phase delay of 4020.26° at the 14.5 Ghz, and the 9.444 inch flare section has a phase delay of 4057.64° at the same frequency, a difference of −37.38°. Summing the two differences (32.32°−37.38°) yields a total phase dispersion between the two horn optimizations at 14.5 Ghz of only −5.06°. Thus, the two horns optimized at different frequencies have virtually equal electrical lengths at 14.5 Ghz.

A similar comparison at the lower band edge (11.7 Ghz) yields a phase dispersion of −6.75°.

The calculated results for the optimizations at the upper and lower boundaries of this bandwidth indicate that slightly better phase tracking performance over the entire band is achieved when the horn is optimized at the lower frequency boundary. In practice, the frequency at which the horn is optimized will typically be between the lower frequency limit of the band and the mid-band frequency.

Figure 5:
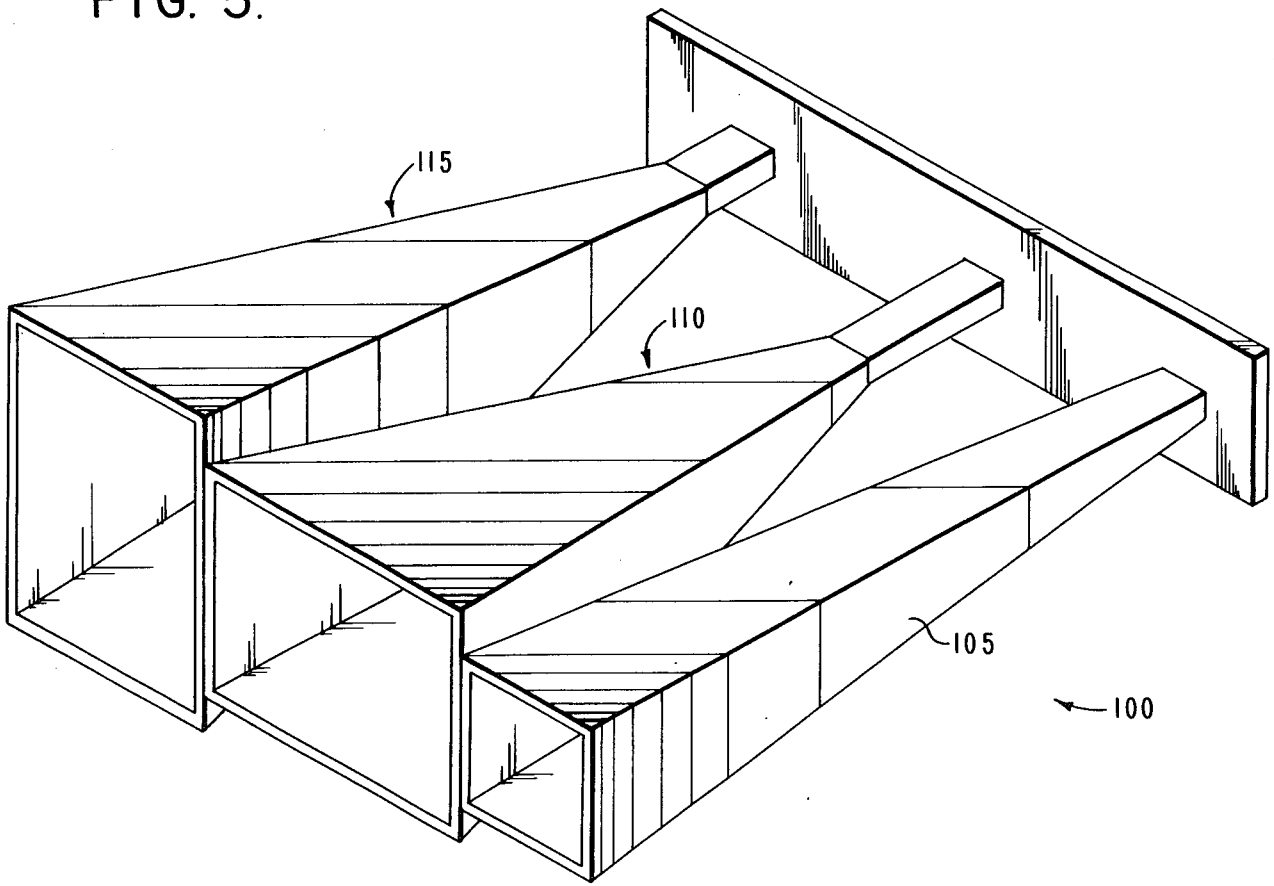
FIG. 5 is a perspective view of an exemplary three horn array embodying the invention.

FIG. 5 is a perspective view of an exemplary three horn array 100 embodying the invention. Horn 105 is the reference horn, and horns 110 and 115 are the optimized horns, each comprising a flared section and a waveguide section as discussed above. The aperture size of each horn 110 and 115 is different from the reference horn in this exemplary array.

As is known to those skilled in the art, to avoid antenna pattern deterioration, the flare angle of the horn should be chosen to minimize the phase error across the aperture. The phase error across a horn with aperture A and axial length $L_a$ is given by Equation 4:

$$\Delta\phi=(2\pi/\lambda)(((A/2)^2+L_a^2)^{\frac{1}{2}}-L_a) \quad (4)$$

The maximum phase error should not exceed 90°, using Reyleigh's criterion. This places a restriction on the amount of phase compensation which may be achieved by the present invention.

An array of horn antennas having non-uniform aperture sizes which phase track over a wide frequency bandwidth has been described. It is understood that the above-described embodiment is merely illustrative of the possible specific embodiments which may represent principles of the present invention. Other arrangements may be devised in accordance with these principles by those skilled in the art without departing from the scope of the invention.

What is claimed is:

1. An array of horn antennas of non-uniform aperture sizes, which phase track over a wide frequency band, comprising:

a first horn antenna having the smallest aperture of said horn antennas and a first overall length $L_h$, said first horn having a first phase delay Y for RF signals at a predetermined frequency within said band; and wherein each of the horn antennas comprising the array other than said first horn antenna have an aperture larger than that of said first horn antenna, and comprise a section of waveguide and a flared section, the flared section length $L_f$ and waveguide section length aggregating to substantially equal said first overall length and cooperating to provide an overall phase delay through said flared and waveguide sections of said horn antennas at said predetermined frequency which substantially matches said first phase delay.

2. The antenna array of claim 1 wherein said horn antennas comprise horns having rectangular cross-sections.

3. The antenna array of claim 2 wherein said waveguide sections comprising said other horn antennas are characterized by a predetermined phase slope per unit waveguide length m2, and the flared sections of said other horn antennas are characterized by a particular phase slope per unit flare length m1, and wherein the respective length $L_f$ of said flared section length of the respective other antennas is substantially equal to $(Y-(m2)X)/(m1-m2)$, and the length of said waveguide section of the respective other antenna is substantially equal to $(X-L_f)$.

4. The antenna array of claim 1 wherein said predetermined frequency is at the middle of said frequency band.

5. The antenna array of claim 1 wherein said predetermined frequency is at the lower edge of said frequency band.

* * * * *